US008920572B2

(12) United States Patent
Chen

(10) Patent No.: US 8,920,572 B2
(45) Date of Patent: Dec. 30, 2014

(54) CLEANING DEVICE AND A CLEANING METHOD OF A FIXED ABRASIVES POLISHING PAD

(75) Inventor: Feng Chen, Shanghai (CN)

(73) Assignee: Semiconductor Manufacturing International (Shanghai) Corporation, Shanghai (CN)

( * ) Notice: Subject to any disclaimer, the term of this patent is extended or adjusted under 35 U.S.C. 154(b) by 515 days.

(21) Appl. No.: 13/211,306

(22) Filed: Aug. 17, 2011

(65) Prior Publication Data

US 2012/0167924 A1 Jul. 5, 2012

(30) Foreign Application Priority Data

Dec. 29, 2010 (CN) ..... 2010 1 0613438

(51) Int. Cl.
*B08B 3/04* (2006.01)
*B24B 53/017* (2012.01)
*B24B 37/24* (2012.01)

(52) U.S. Cl.
CPC ..... *B24B 53/017* (2013.01); *B24B 37/245* (2013.01)
USPC ..... 134/10; 134/21; 134/33; 134/34; 451/56; 451/60

(58) Field of Classification Search
CPC ..... B24B 53/017; B24B 37/04; B08B 3/02; B08B 3/024; B08B 3/04; B08B 3/041
See application file for complete search history.

(56) References Cited

U.S. PATENT DOCUMENTS

| | | | | |
|---|---|---|---|---|
| 5,645,682 | A * | 7/1997 | Skrovan | 438/692 |
| 5,916,010 | A * | 6/1999 | Varian et al. | 451/38 |
| 6,139,406 | A * | 10/2000 | Kennedy et al. | 451/67 |
| 6,168,502 | B1 * | 1/2001 | Allman et al. | 451/38 |
| 2002/0090896 | A1 | 7/2002 | Li et al. | |
| 2003/0124960 | A1 * | 7/2003 | Wada et al. | 451/41 |

FOREIGN PATENT DOCUMENTS

CN 1246402 A 8/2000

* cited by examiner

*Primary Examiner* — Nicole Blan
*Assistant Examiner* — Ryan Coleman
(74) *Attorney, Agent, or Firm* — Anova Law Group, PLLC

(57) ABSTRACT

A device for cleaning a fixed abrasive polishing pad includes a main body having a surface facing the polishing pad, an inlet coupled to an end of the main body and configured to supply a cleaning liquid, an inject orifice coupled to the inlet for injecting the cleaning liquid and being provided on the surface of the main body, an outlet coupled to the end of the main body, and a recycle orifice coupled to the outlet, and being provided on the surface of the main body.

6 Claims, 2 Drawing Sheets

CLEANING DEVICE AND A CLEANING METHOD OF A FIXED ABRASIVES POLISHING PAD

CROSS-REFERENCES TO RELATED APPLICATIONS

The present application claims the priority of Chinese Patent Application No 201010613438.9, entitled "A Cleaning Device And A Cleaning Method Of A Fixed Abrasives Polishing Pad", and filed on Dec. 29, 2010, the entire disclosure of which is incorporated herein by reference.

BACKGROUND OF THE INVENTION

1. Field of the Invention

This invention relates to chemical mechanical polishing in semiconductor fabrication, and more particularly, to cleaning of a fixed abrasive polishing pad.

2. Description of Prior Art

Current processing of semiconductor wafers includes deposition of several layers containing a plurality of patterns and vertically interconnected elements for forming an integrated circuit (IC) device. A typical integrated circuit may have six or more layers of metal wiring that are isolated by interlayer dielectric layers. As the number of layers increases, surface irregularities of the wafer will be a problem for acceptable yield and long-term reliability of a chip. Therefore, a planarization process should be performed on a processed wafer to obtain a smooth surface. In the 1980's, IBM had introduced techniques for chemical mechanical polishing (CMP) of processed wafers. CMP was firstly applied to planarization for inter-metal dielectric (IMD) in backend process. CMP can effectively ensure surface planarization of a wafer or a processed substrate. A very thin layer of material can be removed from a surface of a work piece by a combined chemical and mechanical interaction. CMP can be used for ultra precision surface machining CMP has become a fast-growing and valuable process for IC fabrication in recent years. The basic principle of CMP is to apply a mechanical force towards a surface of the wafer, thereby generate a motive power leading to cracking corrosion in a surface thin layer with which chemical substance of abrasive liquid reacts to improve etching rate.

With slurries as polishing solutions, particles removed from the wafer or substrate to be polished are together rinsed with the slurries. A large amount of slurries will be used. An alternative process is the use of a fixed abrasive polishing pad, where an abrasive is contained within the pad.

The principle of a fixed abrasives chemical mechanical polishing is two-body abrasion, that is, a work piece is polished by abrasives fixed on a polishing pad, with an inevitable consequence, that some byproducts of micro particles during polishing such as some dropped fixed abrasive particles in operation, if not cleared away, not only affect the polishing rate, but also scratch the work piece, then affect the polishing precision and yield. To solve this problem, a prior art technique provides a chemical mechanical polishing table with a caterpillar regulating brush that at least includes a main body structure having a long shaft and a caterpillar on which multiple hard particles and rollers are distributed. The caterpillar covers the external surface of the main body structure and revolves at a fixed speed. The rollers are arranged axially and in parallel to an internal side of caterpillar and are in contact with the caterpillar. The rollers rotate under the drive of the caterpillar. There are multiple particles on a surface of the caterpillar for scraping a surface of a polishing pad to remove the residual impurities remained on the polishing pad. The caterpillar regulating brush also includes a cleaning device for cleaning the caterpillar to remove residual impurities during the caterpillar regulating brush scraping. Although a part of the polishing byproducts may be removed through this technique, this technique has low efficiency and is limited to cleaning capability for low particles precision on the caterpillar and is easily polluted by the byproducts, so the technique may not be suitable to be used as the cleaning device. American Patent Application No US2002/0090896A1 discloses a pad cleaning technique for a CMP system that uses for a fixed abrasive chemical mechanical polishing. The pad cleaning for a CMP system use one or more nozzles that are arranged at an angle relative to a surface of a cleaned polishing pad for spraying liquids at pressures of about 30 psi to about 300 psi or greater to clear away byproducts of micro particles. Although this disclosure improves cleaning efficiency, the micro particles remained on the surface of the polishing pad cannot be removed in time by simply cleaning using pressure, and scratching of a work piece cannot be avoided as the byproducts may migrate to the polishing interface.

A conventional chemical mechanical polishing equipment includes a means for holding a wafer or substrate to be polished (referred to as a "wafer chuck"), a polishing pad, a means to support the polishing pad (referred to as a "platen"), a supply mechanism for supplying abrasive slurry. The wafer is held by the wafer chuck having the side to be polished facing down towards the polishing pad. The polishing pad is not abrasive. During the chemical mechanical polishing, the rotating wafer chuck presses the wafer with an appropriate pressure towards the polishing pad. The slurry is delivered to the surface of the polishing pad. The slurry contains submicron abrasives or nano-abrasives and chemical solution that fill a space between the wafer and the polishing pad, and produce chemical reactions on the surface of the wafer. Reactants forming on the surface of the wafer are removed under a mechanical action of the abrasives. The polishing pad generally includes polymer, such as polyurethane, polyester, and the like.

FIG. 1 schematically illustrates a conventional system for cleaning a fixed abrasive polishing pad. The conventional cleaning system includes a nozzle for delivering a polishing liquid which includes deionized water. A wafer to be polished 1 is fixed on the wafer chuck by means of vacuum. During the polishing operation of wafer 1, a platen (e.g., polishing table) rotates a fixed abrasive polishing pad 2 with a rotation speed between 50 revolutions per minutes (rpm) and 200 rpm. In a polishing contacting region, a prescribed amount of pressure and a rotation speed difference between the polishing pad 2 and the wafer 1 are provided for polishing wafer 1. A cleaning device 3 located outside the polishing contacting region is coupled to a supply system of cleaning liquid (e.g., deionized water). While polishing wafer 1, the cleaning device 3 supplies a cleaning liquid (deionized water) through an inlet 4 and the cleaning water is ejected through a nozzle to remove micro particles that are deposited in the grooves of the fixed abrasive polishing pad 2. The cleaning liquids that carry micro byproducts are then discharged, and the polishing pad is cleaned.

In the fixed abrasive chemical mechanical polishing system described above, an amount of hydraulic pressure ranging from 30 psi to 300 psi is needed to wash away the micro particles disposed in the grooves of the polishing pad. However, a homogeneous hydraulic pressure of the cleaning liquid is difficult to be maintained throughout the polishing pad. For example, the washing pressure in the region of the polishing pad which is more distant from the nozzle is weak relatively to the washing pressure in the region close to the nozzle; the conventional system may not ensure that micro byproducts can be effectively removed.

Therefore, there is a need to have a method and system for cleaning a fixed abrasive polishing pad that can effectively remove micro particles that may cause scratches and defects in the surface of the wafer during polishing.

BRIEF SUMMARY OF THE INVENTION

Embodiments of the present invention provide a device for cleaning a fixed abrasive polishing pad. In an embodiment, the device includes a main body having a surface facing the polishing pad, an inlet coupled to an end of the main body and configured to supply a cleaning liquid, a number of inject orifices coupled to the inlet and being provided on the surface of the main body; an outlet coupled to the end of the main body; and a number of recycle orifices coupled to the outlet and being provided on the surface of the main body.

Optionally, the number of the inject orifices is greater than or equal to the number of the recycle orifices.

Optionally, the number of inject orifices comprises one to four rows the number of the recycle orifices comprises one to four rows.

Optionally, each row of the inject orifices or each row of the recycle orifices comprises six and twenty orifices.

The present invention also provides a method for cleaning a fixed abrasives polishing pad. The method comprises:

providing a fixed abrasive polishing pad on a rotatable polishing table;

providing a cleaning device over the fixed abrasive polishing pad;

starting up the polishing table to rotate the polishing pad, cleaning the fixed abrasive polishing pad with a cleaning liquid, spraying the cleaning liquid through an inject orifice, and recycling the cleaning liquid through a recycle orifice.

Optionally, a cleaning process of the cleaning device includes rotating the polishing table at a first rotation speed, operating the inject orifice and the recycle orifice simultaneity; rotating the polishing table at a second rotation speed, stopping the operation of the recycle orifice, and continuing the operation of the inject orifice, wherein the second rotation speed is higher than the first rotation speed. Optionally, the first rotation speed ranges from about 5 rpm to about 20 rpm, and the second rotation speed ranges from about 50 rpm to about 200 rpm.

Optionally, a distance from the jet orifice to the recycle orifice is between 1 mm and 10 mm.

Optionally, while the polishing table rotates at the first rotation speed, the inject orifice sprays the cleaning liquid at a first flow rate and the recycle orifice absorbs the cleaning liquid at a second flow rate that is higher than the first flow rate. Optionally, the first flow rate is between 200 ml/min and 1000 ml/min, and the second flow rate is between 1000 ml/min and 5000 ml/min.

Compared with the prior art, the technical solution provided by the present invention can effectively reduce scratching of a work piece in the process of the fixed abrasive chemical mechanical polishing, and improve the yield and production efficiency.

DETAILED DESCRIPTION OF THE INVENTION

Hereunder, the present invention will be described in detail with reference to embodiments, in conjunction with the accompanying drawings.

A fixed abrasives chemical mechanical polishing technology developed on the base of these includes a rotary device for fixing a wafer ("chuck"), a polishing table for holding a polishing pad and a cleaning system. As fixed abrasives on a polishing pad replace free abrasives, the supply system for supplying polishing liquid is omitted. A basic structure of the polishing pad is similar to a structure of sand paper. The polishing pad of composite construction is formed by using resin binder to cohere submicron abrasives or nano-abrasives to form fine particles in a particular shape of three dimensional structure (about tens micrometers to hundreds micrometers in length and width, about tens micrometers in height) and accurately bonding the fine particles on a polymeric substrate. The fixed abrasives polishing pad replaces the free abrasives polishing pad in conventional chemical mechanical polishing. The cleaning system generally uses a cleaning brush and a liquid jet device, by means of brushing away or washing, to remove micro particles which drop off during polishing, such as fixed abrasives and the like.

Embodiments of the present invention provides a device for cleaning a fixed abrasive polishing pad. The device includes a main body having a surface facing the polishing pad. In an embodiment, the main body may be an elongated rod that is extended over a portion of the polishing pad, the elongated rod contains an end. The device also includes an inlet coupled to the end of the main body for supplying a cleaning liquid. The device further includes a number of inject orifices that are provided on the surface of the main body, the inject orifices are coupled to the inlet. The device also includes an outlet that is coupled to the end of the main body and a number of recycle orifices coupled to the outlet, the recycle orifices are configured to absorb the cleaning liquid that is sprayed by the inject orifices.

The present invention provides a method for cleaning a fixed abrasive chemical mechanical polishing pad. The cleaning method includes:

Providing a fixed abrasive polishing pad on a rotatable polishing table;

Providing a polishing pad cleaning device over the fixed abrasives polishing pad;

Starting up the polishing table to rotate the polishing pad, cleaning the fixed abrasives polishing pad with a cleaning liquid; and The polishing pad cleaning device includes an inject orifice for spraying a cleaning liquid and a recycle orifice for clearing the liquid. The jet orifice is used for spraying the cleaning liquid to wash or spray micro particles away, and the recycle orifice is used for absorbing the cleaning liquid that carries the micro byproducts in order to remove them.

An embodiment provided by the present invention will be described in conjugation with FIG. 2 to FIG. 4 as below.

Figure 1:
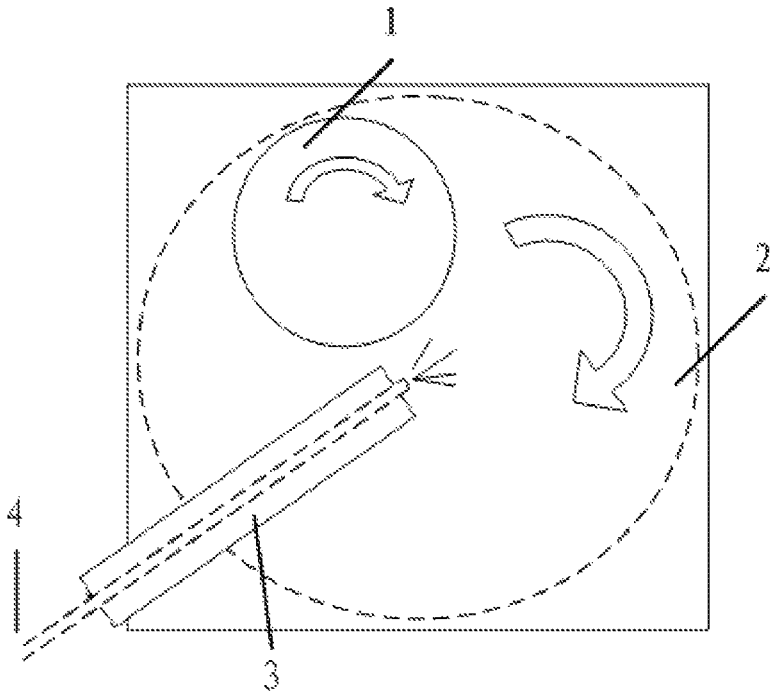
FIG. 1 (prior art)
FIG. 1 schematically illustrates a device for cleaning a polishing pad according to a prior art.
Figure 2:
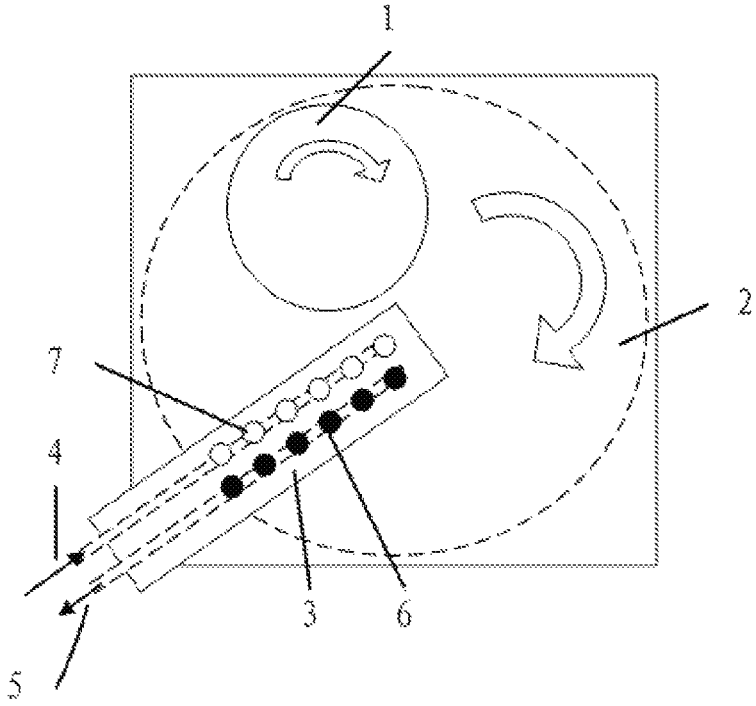
FIG. 2 schematically illustrates a system for cleaning a fixed abrasive polishing pad according to an embodiment of the present invention.

FIG. 2 is a schematic top view of a portion of a system for cleaning a fixed abrasive polishing pad according to an embodiment of the present invention. As shown, a work piece 1 to be polished is mounted face down on a chuck. The work piece 1 can be a wafer or a substrate in a particular step of semiconductor fabrication that can be, for example, a shallow trench isolation (STI) process, copper polishing, tungsten polishing, Ge—Sb—Te phase-change material polishing or HiK gate metal polishing process and the like. Other than the above mentioned processes which need polishing, embodiments of the present invention provide solutions for cleaning a fixed abrasives chemical mechanical polishing pad that can be applied to any polishing technology that uses a fixed abrasive chemical mechanical polishing. In an exemplary embodiment, the wafer to be polished in is in a STI process. Depending on the abrasive machining environment and the condition of the wafer, the to be polished wafer can be mounted on the chuck with wax or vacuum. Embodiments of the present invention can operate independently from any form of chuck. In an embodiment, wafer 1 is mounted face down on a chuck with vacuum.

The system includes a fixed abrasive polishing pad 2 mounted on a rotatable polishing table. Polishing pad 2 includes fixed abrasives that may be structured by cohering submicron abrasives or nano-abrasives to form fine particles in a particular shape of a three dimensional structure (about tens of micrometers to hundreds of micrometers in length and width, about tens of micrometers in height). The fine particles are bonded with a defined pattern on a polymeric substrate. In an embodiment, the abrasives may include corundum (alumina), silex (silicon dioxide), ceria or carbide and the like depending on the machining environment. The following description will employ a structured polishing pad having corundum as abrasives.

The system also includes a polishing pad cleaning device 3 over the polishing pad 2. Referring to FIG. 2, the polishing pad cleaning device 3 includes an inlet 4 for dispensing a cleaning liquid, an outlet 5 for removing the dispended cleaning liquid, plurality of orifices 7 for injecting the cleaning liquid and a plurality of recycle orifices 6 for receiving the recycled cleaning liquid. The cleaning liquid injecting orifice 7 is coupled with the cleaning liquid inlet 4 to spray a cleaning liquid to clear micro particles byproducts away, and the cleaning liquid recycle orifice 6 is coupled with the cleaning liquid outlet 5 to absorb and remove the cleaning liquid carrying the micro particles byproducts. Depending on the application, the polishing pad cleaning device 3 can have a tetragonum, trapezium, ellipse, or other regular shape or irregular shape. In an example embodiment of present invention, the cleaning device 3 is an elongated rod. The number of the cleaning liquid jet orifice 7 and the cleaning liquid recycle orifice 6 in the polishing pad cleaning device 3 can be independently defined depending on the machining condition. In a preferable embodiment, the number of the cleaning liquid jet orifice 7 is greater than or equal to the number of the cleaning liquid recycle orifice 6. In a preferred embodiment, the cleaning liquid jet orifice 7 and the cleaning liquid recycle orifice 6 can be arranged in one row to four rows, and each row of the cleaning liquid jet orifice 7 and the cleaning liquid recycle orifice 6 can have six to twenty orifices, so that the remained micro particles byproducts can be effectively removed. In an embodiment, each of the cleaning liquid jet orifice 7 and the cleaning liquid recycle orifice 6 is arranged in four rows, and each row contains either six cleaning liquid jet orifices 7 or cleaning liquid recycle orifices 6. In an alternative embodiment, the plurality of cleaning liquid jet orifices 7 and the plurality of cleaning liquid recycle orifice 6 can be implemented in one row, each row may contain either twenty cleaning liquid jet orifices 7 or cleaning liquid recycle orifices 6. The different implementations do not affect the scope of the present invention, so further detailed description is omitted.

In operation, the chuck rotates the wafer 1 at a first rotation speed, and the polishing table rotates the polishing pad 2 at a second rotation speed. A pressure is applied to the wafer 1 that is brought into contact with the fixed abrasives polishing pad 2. The cleaning device 3 cleans the polishing pad 2 through an injected cleaning liquid. The rotation speed of the wafer 1 and the amount of the pressure can be set as predetermined values depending on the machining environment and the condition of the wafer. After the polishing pad 2 finishes polishing the wafer 1 in a contacting region, micro particles byproducts disposed in grooves between the abrasives of the polishing pad 2 are moved to a non-contacting region, and then the cleaning device 3 starts cleaning the polishing pad 2.

Figure 3:
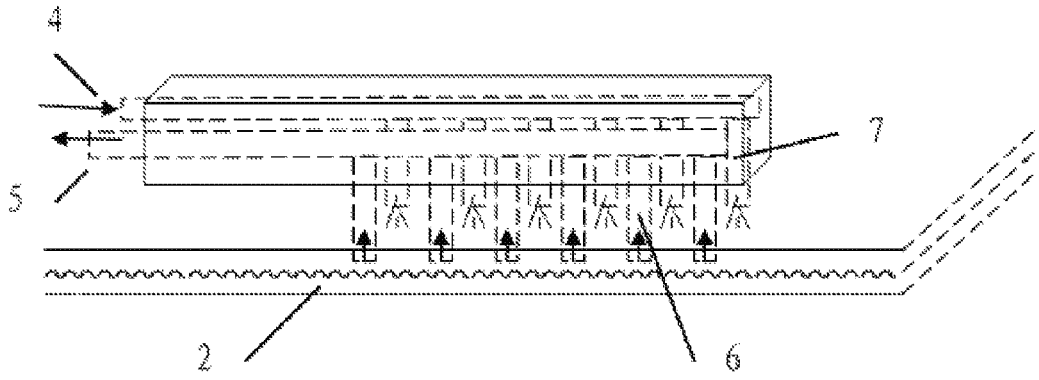
FIG. 3 is a schematically side view illustrating an operating state of a cleaning system according to an embodiment of the present invention.

Referring to FIG. 3, the cleaning device 3 starts cleaning the polishing pad 2. A distance from the inject orifice and the recycle orifice to the polishing pad can be set depending on the embodiments. In a preferred embodiment, the distance between the inject orifice and the recycle orifice ranges about 1 millimeter to about 10 millimeters. In an embodiment, the distance from the jet orifice and the recycle orifice to the polishing pad is about 10 millimeters. During the cleaning operation, the cleaning liquid inlet 4 supplies a cleaning liquid that is sprayed through the cleaning liquid inject orifice 7 of the cleaning device 3 to clean the polishing pad 2. At the same time the cleaning liquid recycle orifice 6 recycles the cleaning liquid carrying the micro particles byproducts, and the cleaning liquid flows out through the cleaning liquid outlet 5, thereby finishing cleaning the polishing pad 2.

Figure 4:
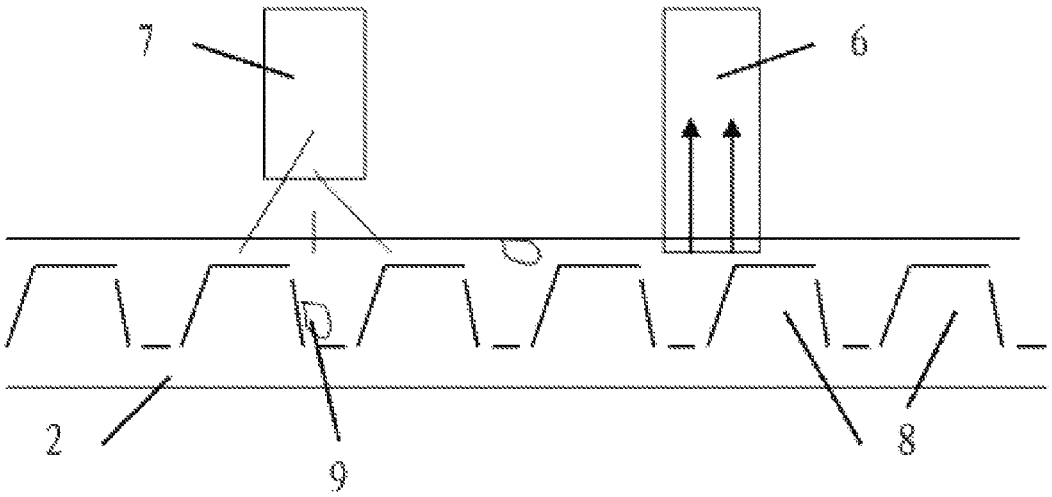
FIG. 4 schematically illustrates a portion of the cleaning device according to an embodiment of the present invention.

As shown in FIG. 4, the cleaning liquid inject orifice 7 sprays the cleaning liquid with a determined hydraulic pressure to wash away the micro particles byproducts 9 that are disposed in the grooves of the abrasives 8. The cleaning liquid is absorbed by the cleaning liquid recycle orifice 6 at a determined rate of feeding flow, and flows out through the cleaning liquid outlet 5. The micro particles byproducts 9 are removed from the grooves in time to prevent the micro particles byproducts from moving into the contacting region, thereby effectively reducing scratch on a polished surface of the wafer 1. The cleaning liquid can be deionized water or other liquid mixed with chemicals for adjusting PH value according to a specific need. In an embodiment of the present embodiment, the cleaning liquid is deionized water.

It should be appreciated that the cleaning liquid jet orifice 7 and the cleaning liquid recycle orifice 6 can be operated synchronously, or they can be operated alone according to different polishing steps. The flow rate for spraying and recycling may be controlled individually for an optimal operation. The polishing process and cleaning process of the polishing pad can be chose according to the application condition and the wafer condition, which does not affect the principle of the present invention. According to a preferable embodiment, a polishing and cleaning process includes a first polishing table 2 that rotates at a first rotation speed, a cleaning liquid jet orifice 7 and a cleaning liquid recycle orifice 6 that synchronously operate. The polishing table 2 then rotates at a second rotation speed, the cleaning liquid jet orifice 7 stops operating, and the cleaning liquid recycle orifice 6 continues to operate; and the second rotation speed is higher than the first rotation speed. In a specific embodiment, the first rotation speed ranges from 5 rpm to 20 rpm, and the second rotation rate ranges from 50 rpm to 200 rpm. In an example embodiment, the first rotation speed is 5 rpm and the second rotation speed is 50 rpm. Alternatively, the first rotation speed can be 20 rpm, and the second rotation speed can be 200 rpm.

In a preferable embodiment, the polishing pad 2 rotates at the first rotation speed, the cleaning liquid jet orifice 7 and the cleaning liquid recycle orifice 6 operate synchronously, the cleaning liquid jet orifice 7 sprays a cleaning liquid comprising deionized water at a first flow rate, and the cleaning liquid recycle orifice 6 absorbs the cleaning liquid of deionized water at a second flow rate, wherein the second flow rate is greater than the first flow rate. In an embodiment, the first flow rate ranges from 200 ml/min to 1000 ml/min, and the second flow rate ranges from 1000 ml/min to 5000 ml/min. In a specific embodiment, the first flow rate is 200 ml/min and the second flow rate is 1000 ml/min.

In an embodiment, the polishing pad 2 rotates at a rotation rate of 5 rpm, and the cleaning liquid jet orifice 7 and the cleaning liquid recycle orifice 6 operate synchronously, wherein the cleaning liquid jet orifice 7 sprays deionized water at the flow rate of 200 ml/min and the cleaning liquid recycle orifice 6 absorbs the deionized water carrying micro particles byproducts at the flow rate of 1000 ml/min. Next, the polishing pad 2 rotates at a rotation speed of 50 rpm, the cleaning liquid jet orifice 7 stops operating, and the cleaning liquid recycle orifice 6 continues operating at the flow rate of 1000 ml/min. After polishing, in the non-contacting region, as micro particles byproducts remained in grooves of the abrasives is cleared away for recycling in time, scratch on the surface of the wafer is reduced, thereby improving yield and production efficiency.

Although the present invention has been disclosed as above with reference to preferred embodiments thereof but will not be limited thereto. Those skilled in the art can modify and vary the embodiments without departing from the spirit and scope of the present invention. Accordingly, the scope of the present invention shall be defined in the appended claims.

What is claimed is:

1. A method for cleaning a fixed abrasive polishing pad using a cleaning device, comprising:

providing a fixed abrasive polishing pad on a rotatable polishing table;

providing the cleaning device over the fixed abrasive polishing pad;

starting up the polishing table to rotate the polishing pad;

providing a cleaning liquid for cleaning the fixed abrasive polishing pad using the cleaning device;

supplying the cleaning liquid through a cleaning liquid inlet to spray the cleaning liquid through one or more inject orifices of a plurality of inject orifices;

recycling the cleaning liquid through one or more recycle orifices of a plurality of recycle orifices that are coupled with a cleaning liquid outlet of the cleaning device such that the cleaning liquid for recycling is absorbed to flow out through the cleaning liquid outlet;

rotating the polishing table at a first rotation speed to polish a wafer, in the meantime, operating the one or more inject orifices by supplying the cleaning liquid and simultaneously operating the one or more recycle orifices by recycling the cleaning liquid; and after rotating the polishing table at the first rotation speed, immediately rotating the polishing table at a second rotation speed and stopping the operating of the one or more inject orifices, while continuing the operating of the one or more recycle orifices, wherein the second rotation speed is higher than the first rotation speed, the first rotation speed ranges from about 5 rpm to about 20 rpm, and the second rotation speed ranges from about 50 rpm to about 200 rpm.

2. The method of claim 1, where a distance between each of an inject orifice and a recycle orifice and the fixed abrasive polishing pad ranges about 1 mm to about 10 mm.

3. The method of claim 1, wherein while the polishing table rotates at the first rotation speed, the one or more inject orifices spray the cleaning liquid at a first flow rate and the one or more recycle orifices absorb the cleaning liquid at a second flow rate that is higher than the first flow rate.

4. The method of claim 3, wherein the first flow rate is between 200 ml/min and 1000 ml/min.

5. The method of claim 3, wherein the second flow rate is between 1000 ml/min and 5000 ml/min.

6. The method of claim 1, wherein the cleaning liquid is deionized water.

* * * * *